US005603599A

United States Patent [19]

Wesslèn et al.

[11] Patent Number: 5,603,599

[45] Date of Patent: Feb. 18, 1997

[54] VACUUM SYSTEM

[75] Inventors: Per-Olof Wesslèn, Buffalo Grove; Steven Kostrova, Lindenhurst, both of Ill.

[73] Assignee: Tetra Laval Holdings & Finance S.A., Pully, Switzerland

[21] Appl. No.: 315,413

[22] Filed: Sep. 28, 1994

[51] Int. Cl.[6] ..... B31B 1/80

[52] U.S. Cl. ..... 414/411; 294/64.2; 493/315; 493/317

[58] Field of Search ..... 414/411; 294/64.2; 493/315, 317; 137/625.11

[56] References Cited

U.S. PATENT DOCUMENTS

| | | | |
|---|---|---|---|
| 810,863 | 1/1906 | Hofstatter . | |
| 826,536 | 7/1906 | Butterfield . | |
| 2,762,274 | 9/1956 | Kerr | 493/315 |
| 3,157,201 | 11/1964 | Littmann . | |
| 3,242,827 | 3/1966 | Winters | 493/315 |
| 3,361,469 | 1/1968 | Yeager | 294/64.2 |
| 3,609,938 | 10/1971 | Paddock . | |
| 3,630,389 | 12/1971 | Schmidt . | |
| 3,648,853 | 3/1972 | Winne . | |
| 3,721,265 | 3/1973 | Hoffland . | |
| 3,773,078 | 11/1973 | Suntheimer . | |
| 3,912,317 | 10/1975 | Ohnaka . | |
| 3,928,942 | 12/1975 | Paddock et al. . | |
| 4,049,020 | 9/1977 | Neveux . | |
| 4,065,001 | 12/1977 | Ohnaka . | |
| 4,194,442 | 3/1980 | Martelli . | |
| 4,458,708 | 7/1984 | Leonard et al. . | |
| 4,631,815 | 12/1986 | Bocchicchio et al. . | |
| 4,768,919 | 9/1988 | Borgman et al. . | |
| 4,775,290 | 10/1988 | Brown et al. . | |
| 4,957,318 | 9/1990 | Blatt | 294/64.2 |
| 4,968,334 | 11/1990 | Hilton . | |
| 5,067,937 | 11/1991 | Aschaber et al. . | |
| 5,155,968 | 10/1992 | Mosse et al. | 493/315 |
| 5,207,553 | 5/1993 | Konagai . | |
| 5,215,515 | 6/1993 | Bershadsky . | |
| 5,277,468 | 1/1994 | Blatt et al. | 294/64.2 |

*Primary Examiner*—Thomas J. Brahan
*Attorney, Agent, or Firm*—McAndrews, Held & Malloy, Ltd.; Patrick N. Burkhart

[57] ABSTRACT

An apparatus for transferring a workpiece from one location of a machine to another is disclosed. The apparatus includes a plurality of picking assemblies that are movable along a closed transfer path. Each of the picking assemblies includes a vacuum manifold assembly that receives a compressed gas, such as compressed shop air. A vacuum generator, such as Venturi device, is disposed in the vacuum manifold assembly and generates a vacuum from the compressed gas received at the input of the vacuum manifold assembly. The vacuum manifold assembly further includes at least on suction cup in fluid communication with the vacuum generated by the vacuum generator.

51 Claims, 15 Drawing Sheets

FIG. 3
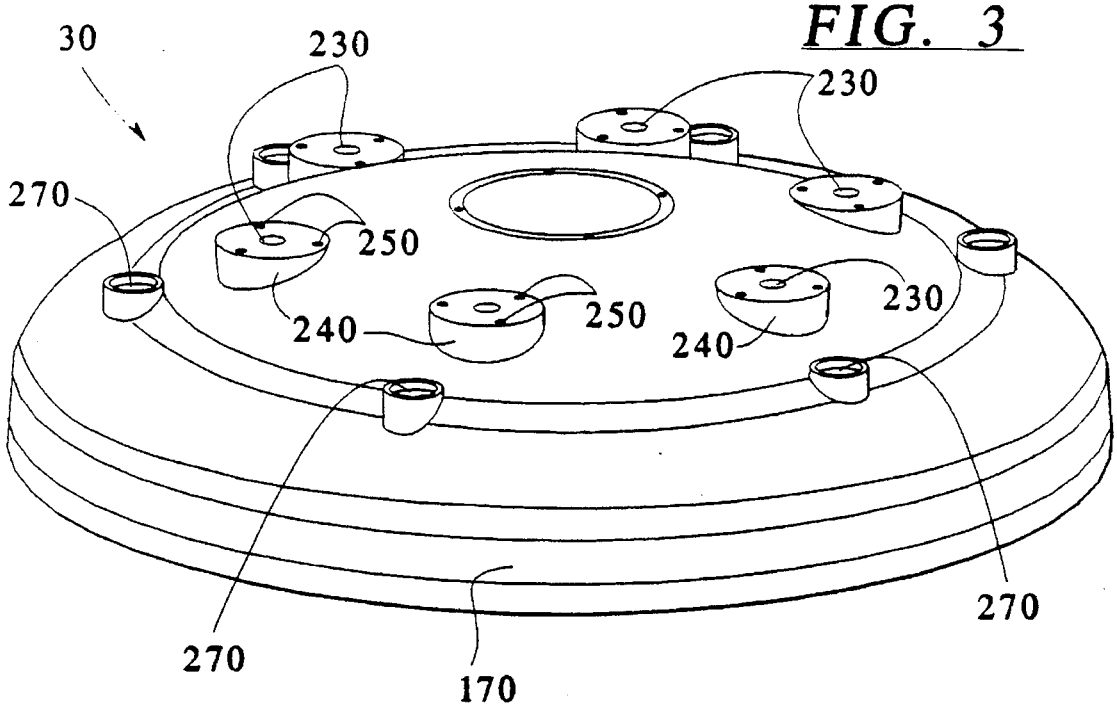
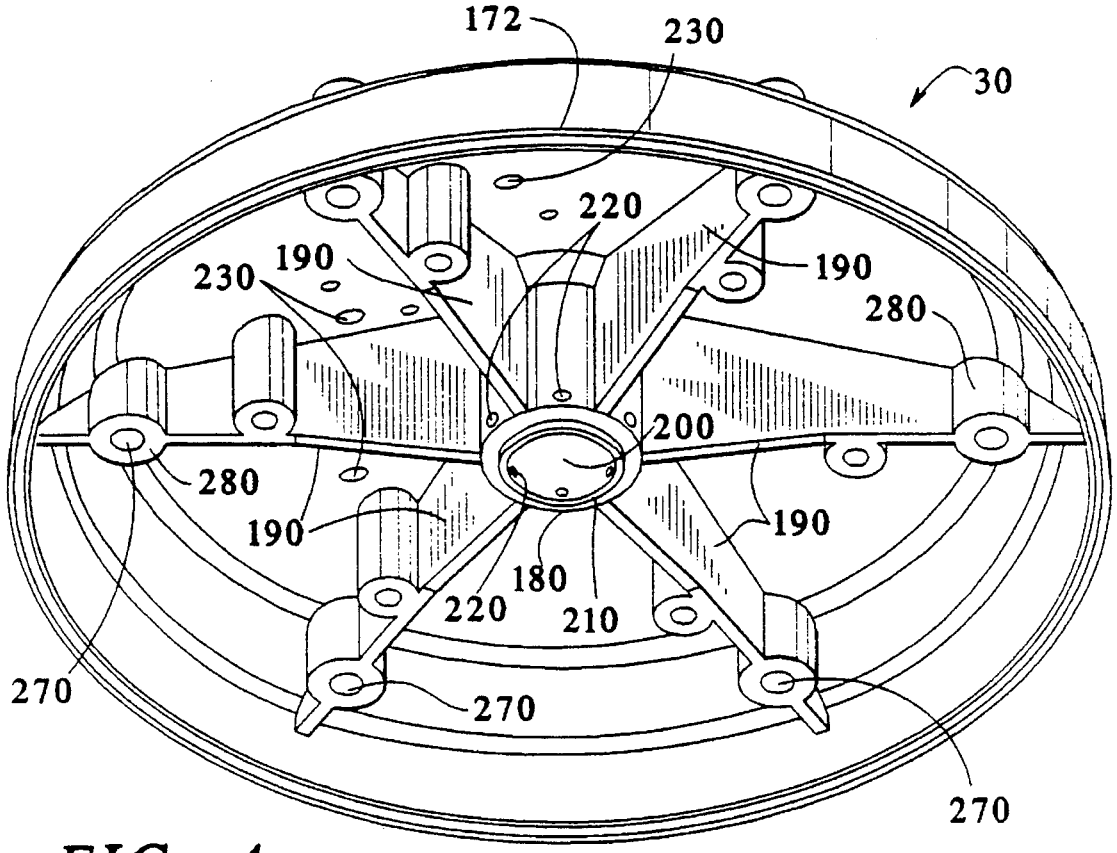
FIG. 4

FIG. 7
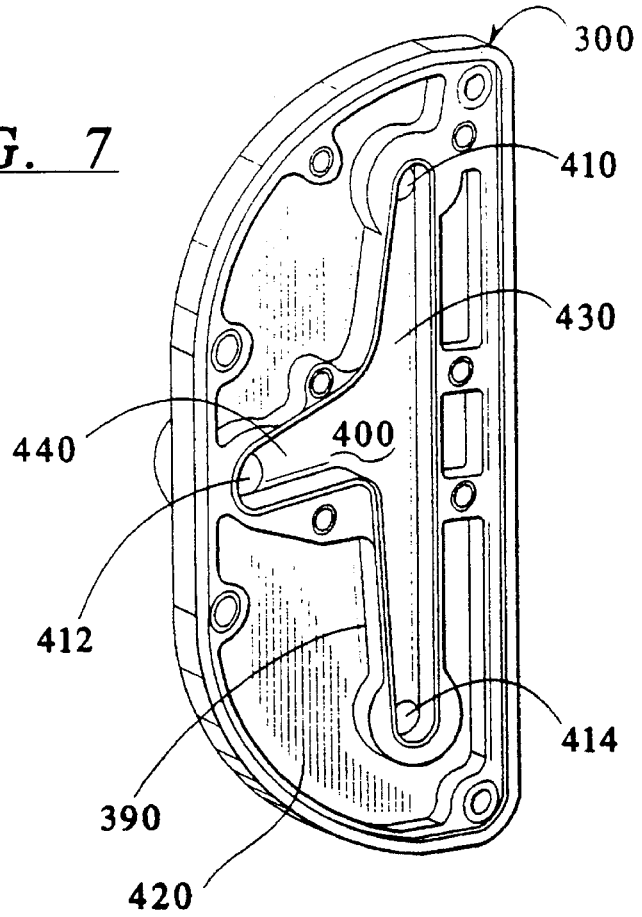
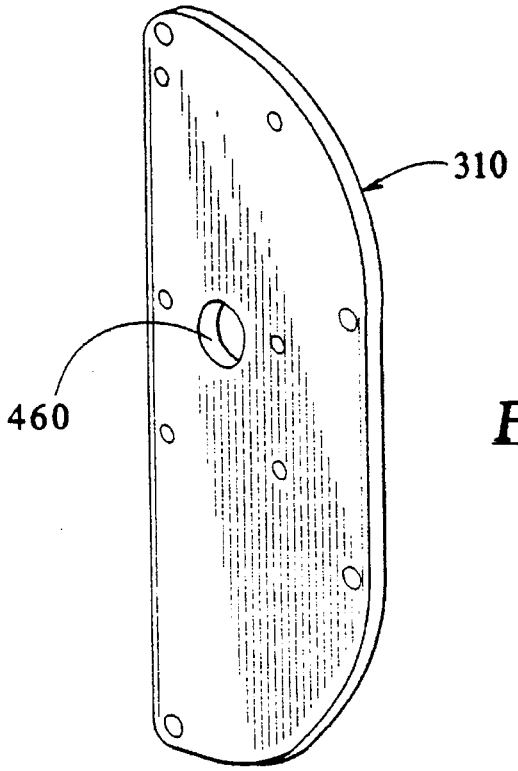
FIG. 8

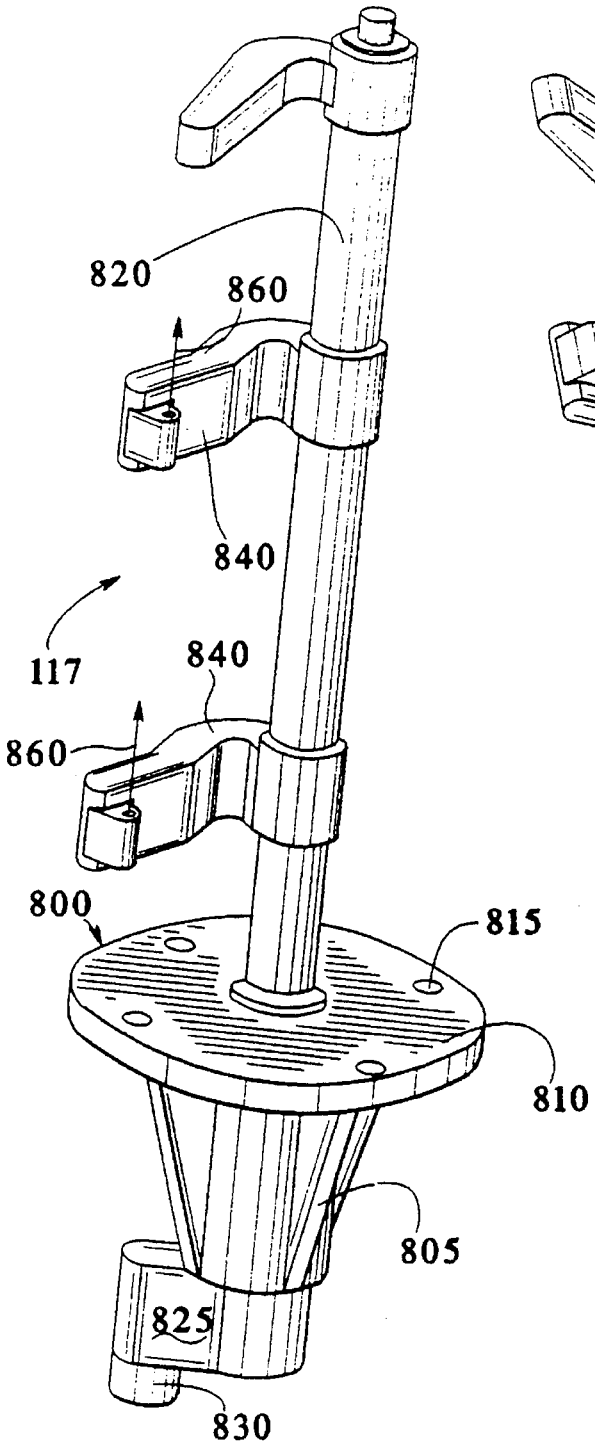
FIG. 13
FIG. 14
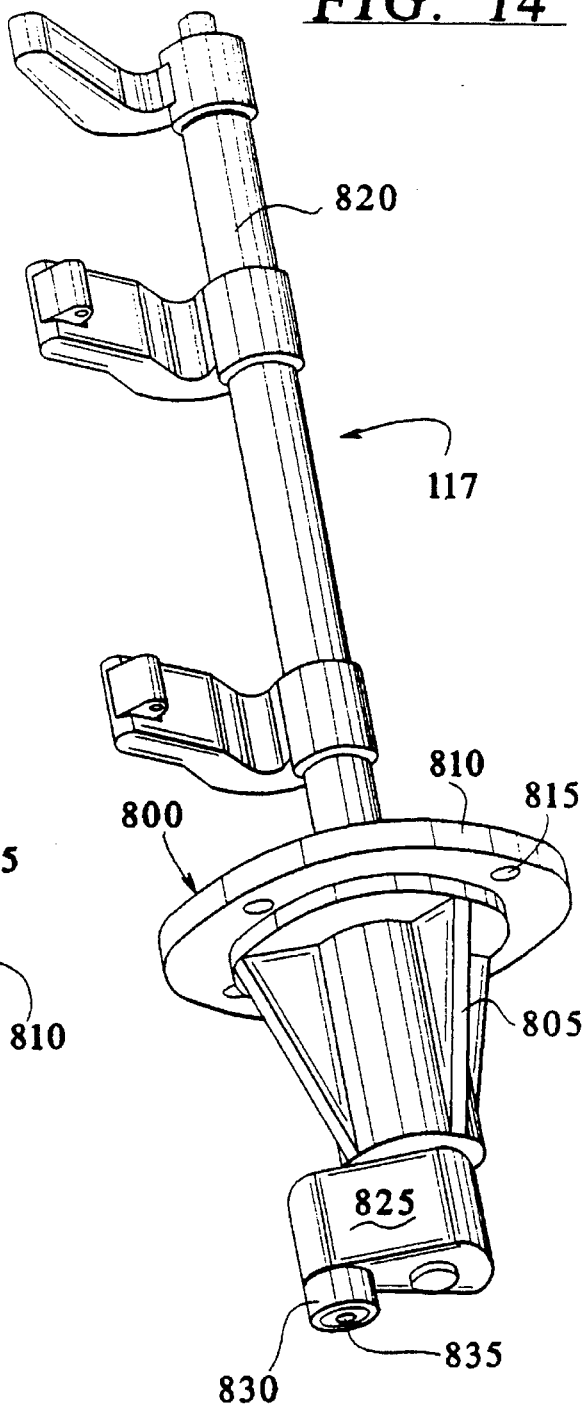

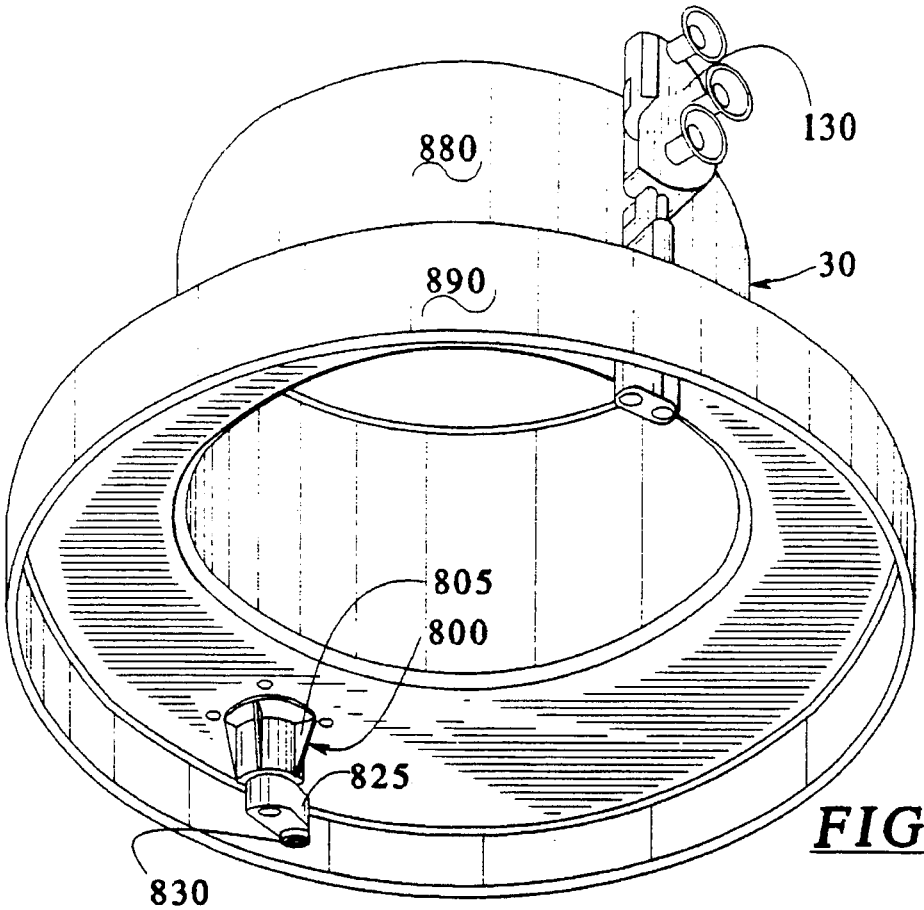
FIG. 15
FIG. 16
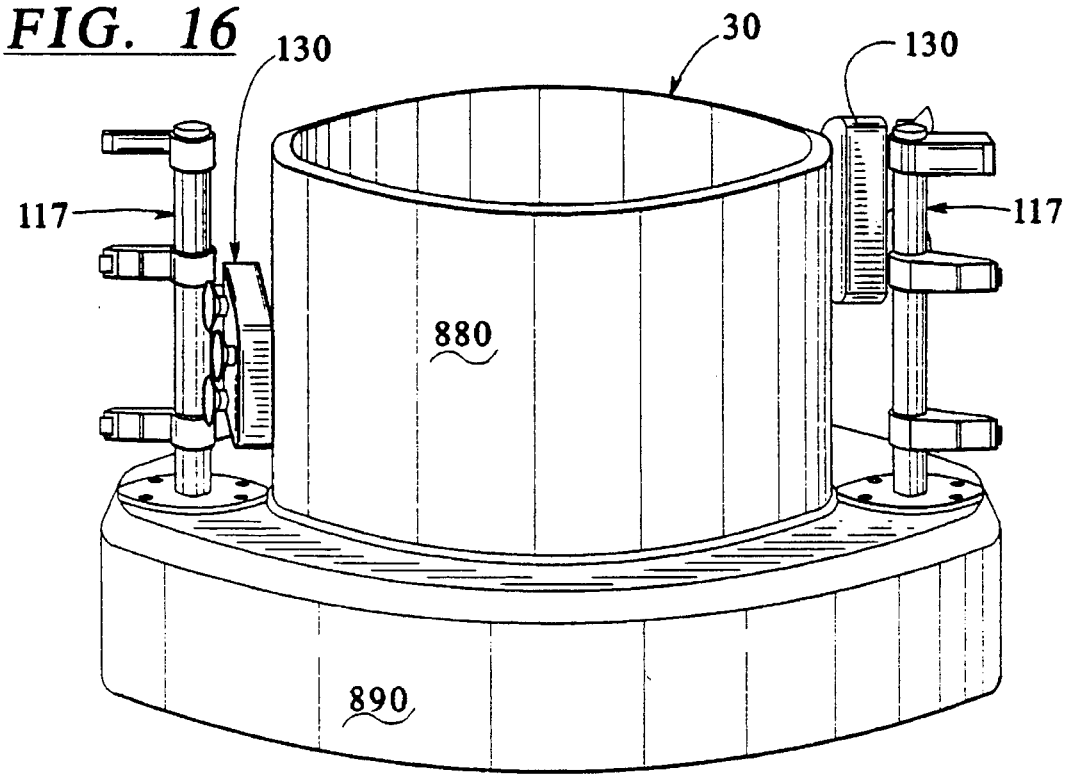

VACUUM SYSTEM

TECHNICAL FIELD

The present invention relates to a vacuum system. More particularly, the present invention relates to a vacuum system for a rotary picker used to transfer blanks in a packaging machine.

BACKGROUND

There are known devices which transfer a workpiece from one location to another within a machine. Such devices are used extensively in packaging machines. One such device, known as a rotary picking assembly, is shown and described in U.S. Pat. No. 5,215,515 to Breshadsky. That rotary picking assembly automatically opens and transfers carton blanks within a packaging machine. The assembly includes a plurality of picker arms that are moved along a closed circular path. Each of the picker arms includes a single suction cup in fluid communication with a vacuum pump. An additional supporting member is mounted immediately behind and moves together with the suction cups for preventing the carton blank from being tilted, misaligned, or knocked off during transfer.

In operation, a carton blank is initially gripped from a magazine or rack by the suction cup of the respective picker arm. The carton blank is broken open by a pivoted transverse member that swings from an open condition to a closed condition Ultimately, the open blank is transferred to a receiving member of a conveyor which transfers the carton to further portions of the packaging machine, for example, for filling and sealing.

Another rotary picking assembly is illustrated in U.S. Pat. No. 5,102,385 to Calvert. The assembly shown and described therein includes a suction cup device that moves radially inwardly and outwardly on a slidable rod as it orbits about a centrally rotating shaft.

In the rotary picking assemblies known in the art, the suction cups are directly supplied with a vacuum that is generated by a vacuum pump. Such vacuum pumps can be quite large and are often inefficient. Additionally, regulation of the vacuum supplied to the suction cups can be difficult to maintain in proper synchronism with the motion of the picker arms (i.e., activating the suction at selected portions of the transfer path). A more efficient and effective vacuum system is therefore desirable.

SUMMARY OF THE INVENTION

An apparatus for transferring a workpiece from one location of a machine to another is disclosed. The apparatus includes a plurality of picking assemblies that are movable along a closed transfer path. Each of the picking assemblies includes a vacuum manifold assembly that receives a compressed gas, such as compressed shop air. A vacuum generator, such as Venturi device, is disposed in the vacuum manifold assembly and generates a vacuum from the compressed gas received at the input of the vacuum manifold assembly. The vacuum manifold assembly further includes at least on suction cup in fluid communication with the vacuum generated by the vacuum generator.

In accordance with one embodiment of the vacuum manifold assembly, the vacuum manifold assembly utilizes a first housing portion that includes a chamber for holding the vacuum generator. Compressed gas is supplied through a connector at an input at the first housing portion and, therefrom, to the input of the vacuum generator. The vacuum manifold assembly further utilizes a second housing portion including a vacuum manifold chamber in fluid communication with at least one suction cup. An intermediate wall is disposed between the first and second housing portions. The intermediate wall has an aperture to provide fluid communication between the vacuum manifold chamber and the vacuum output of the vacuum generator. The first housing portion may include a further exhaust aperture, wherein the exhaust aperture and the input aperture are disposed along generally parallel axes and, further, are co-planar.

In accordance with a still further aspect of the vacuum manifold assembly, the assembly can include three suction cups arranged at the apices of a triangle. In such instance, the second housing portion is provided with at least three suction cup apertures that facilitate fluid communication between the vacuum manifold chamber and the three suction cups. The vacuum manifold chamber includes a first vacuum chamber extending along a generally straight path between two of the suction cups and a second vacuum chamber extending from and transverse to the first vacuum chamber and providing fluid communication between the first vacuum chamber and the third suction cup.

A valve assembly is used to control the flow of the compressed gas to the vacuum manifold assemblies disposed on the various picking assemblies. The valve assembly controls the flow of the compressed gas to the plurality of picking assemblies in synchronism with the movement of the plurality of picking assemblies so that each of the picking assemblies is supplied with compressed gas along only a portion of the closed transfer path.

In accordance with one embodiment of the valve assembly, the valve assembly includes a housing having a generally conical interior chamber and a distribution chamber. The distribution chamber proceeds about less than the full circumference of the interior conical chamber and is in fluid communication with a fluid supply channel. The fluid supply channel is disposed through sidewalls of the housing.

The valve assembly further includes a distribution member that is disposed at least partially in the conical interior chamber of the housing. The distribution member has a generally conical nose portion which is shaped to conform to the conical interior chamber. The distribution member further includes a plurality of fluid communication channels formed therein, each of which has a fluid inlet and a fluid outlet. The fluid inlets of the plurality of fluid communication channels are disposed about the circumference of the conical nose and coincide in position with the distribution chamber.

In operation, the distribution member and the housing are disposed for relative rotation with one another. The relative rotation causes sequential fluid communication between selected ones of the plurality of fluid communication channels and the distribution chamber. Thus, a compressed gas supplied to the distribution chamber is selectively supplied to one or more of the fluid communication channels dependent on the relative rotation between the distribution member and the housing.

Other objects and advantages of the present invention will become apparent upon reference to the accompanying detailed description when taken in conjunction with the following drawings.

BRIEF DESCRIPTION OF THE DRAWINGS

FIGS. 3 and 4 illustrate one embodiment of a hub assembly.

FIGS. 5–8 illustrate one embodiment of a vacuum assembly for use in the apparatus of FIG.

FIGS. 13–14 illustrate a further embodiment of a picking arm.

FIGS. 15–16 illustrate a further embodiment of a hub assembly.

DETAILED DESCRIPTION OF THE PREFERRED EMBODIMENT

Figure 1:
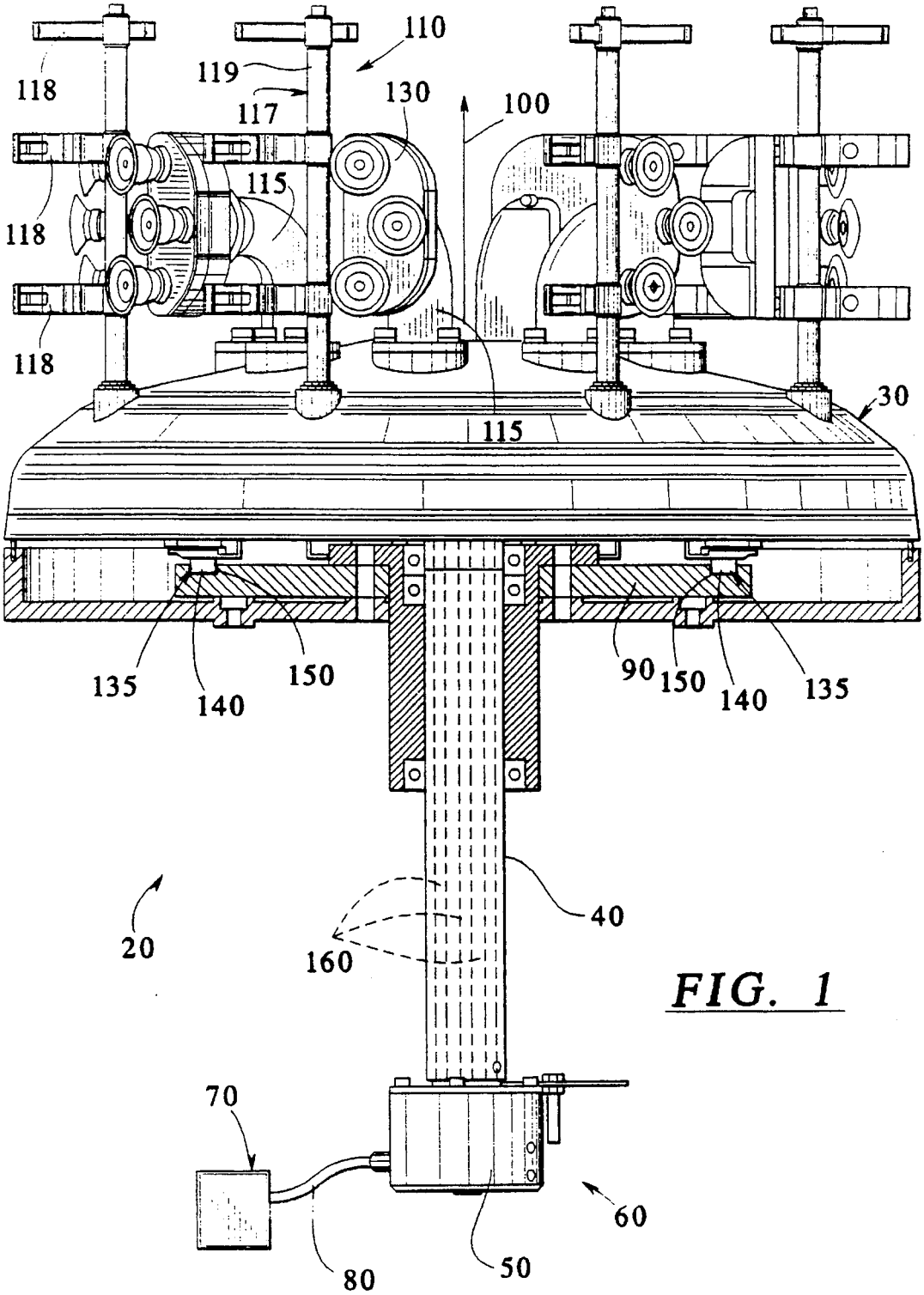
FIG. 1 is a partial cross-sectional view of one embodiment of a rotary picking apparatus.

FIG. 1 is a side elevational view of a picking apparatus, shown generally at 20. The picking apparatus 20 includes a hub assembly 30 that is rigidly connected to a hollow shaft 40. The hollow shaft 40 extends from the hub assembly 30 to a position proximate the top portion of the housing of a valve assembly 60. The valve assembly 60, in turn, is connected to receive a compressed gas, such as shop air from, for example, a compressor 70, along a pressurized gas line 80. A guide member 90 is disposed beneath the hub assembly 30 and, for example, may be integral with a frame that supports the assembly 20. Both the guide member 90 and the housing 50 of the valve mechanism 60 are mounted in a fixed position. The hub assembly 30 and hollow shaft 40, however, are mounted for co-rotation about a rotation axis, shown at arrow 100.

A plurality of picking assemblies 110 are attached to the hub assembly 30. Each picking assembly 110 includes a vacuum manifold assembly 130 mounted to the hub assembly 30 by, for example, a rigid sheath 115. A picking arm 117 is disposed proximate each of the picking assemblies. Each of the picking arms 117 include a shaft 119 extending through the hub assembly 30, one or more transverse arms 118 extending from the shaft 119 in the region of the shaft 119 above the hub assembly 30, and a follower arm 135 mounted to the shaft 119 in a region of the shaft below the hub assembly 30.

Figure 2A:
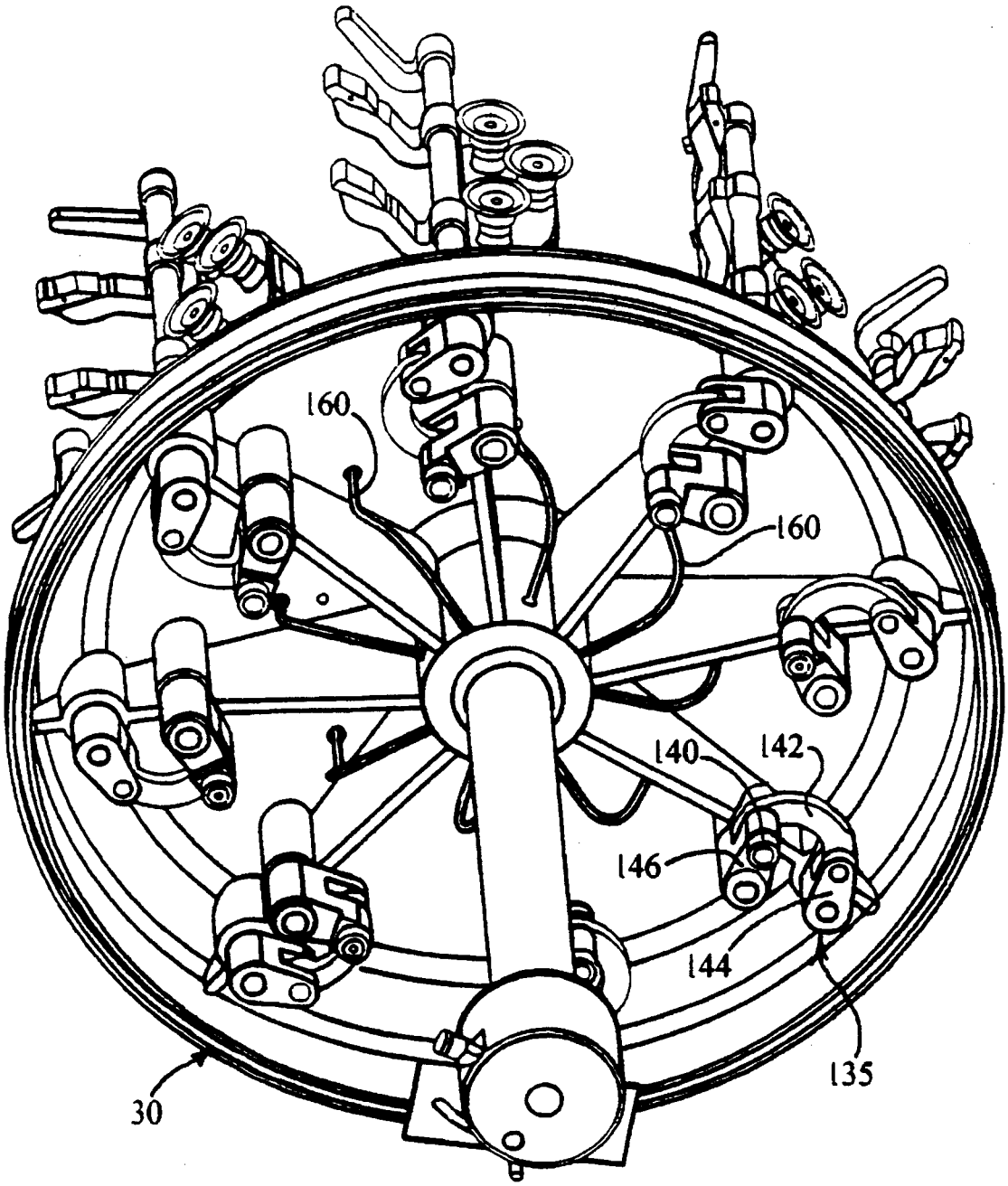
FIG. 2A is a bottom perspective view of the apparatus of FIG. 1.
Figure 2B:
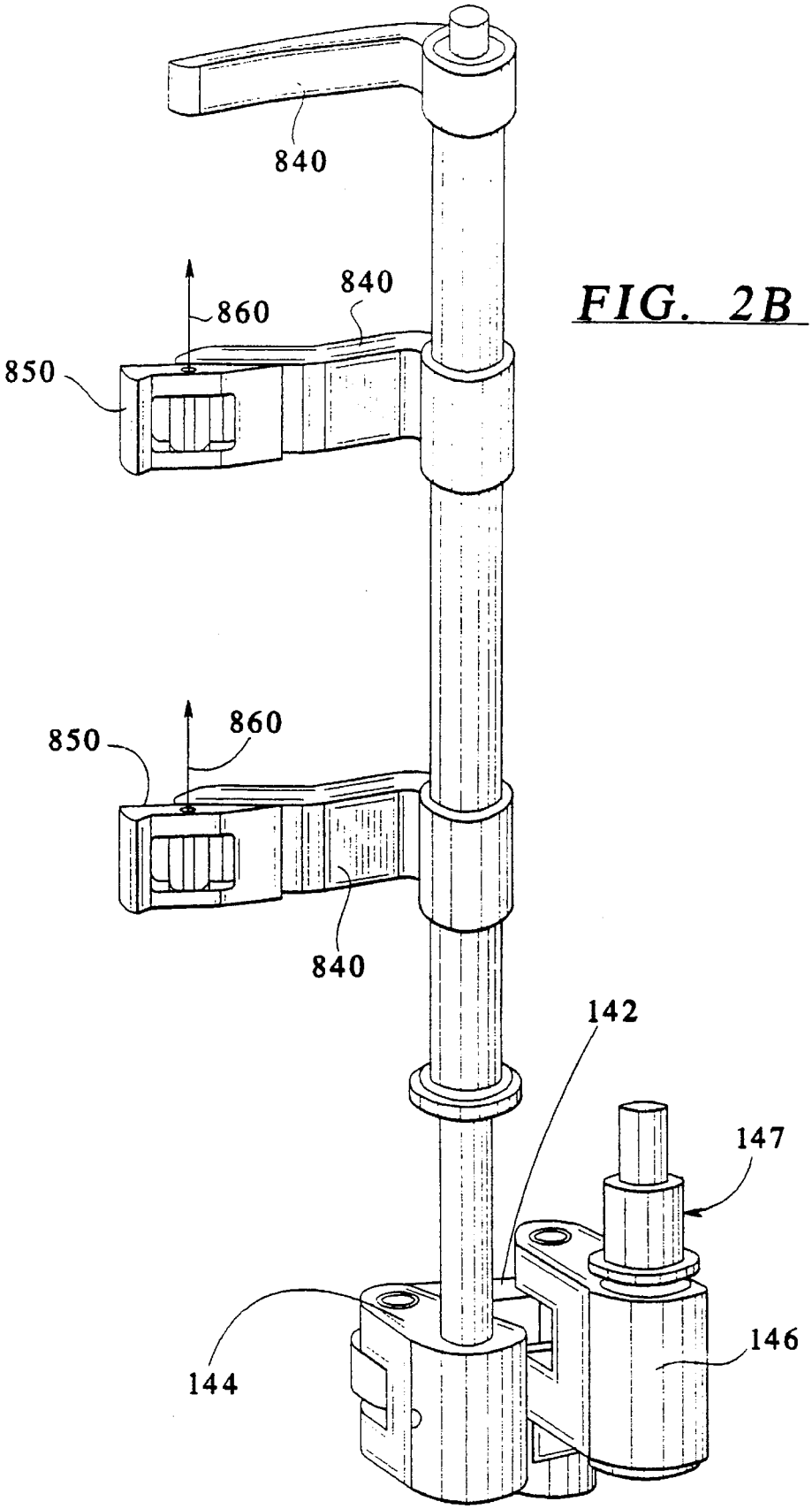
FIG. 2B is a perspective view of one embodiment of a picking arm for use in the apparatus.
Figure 5:
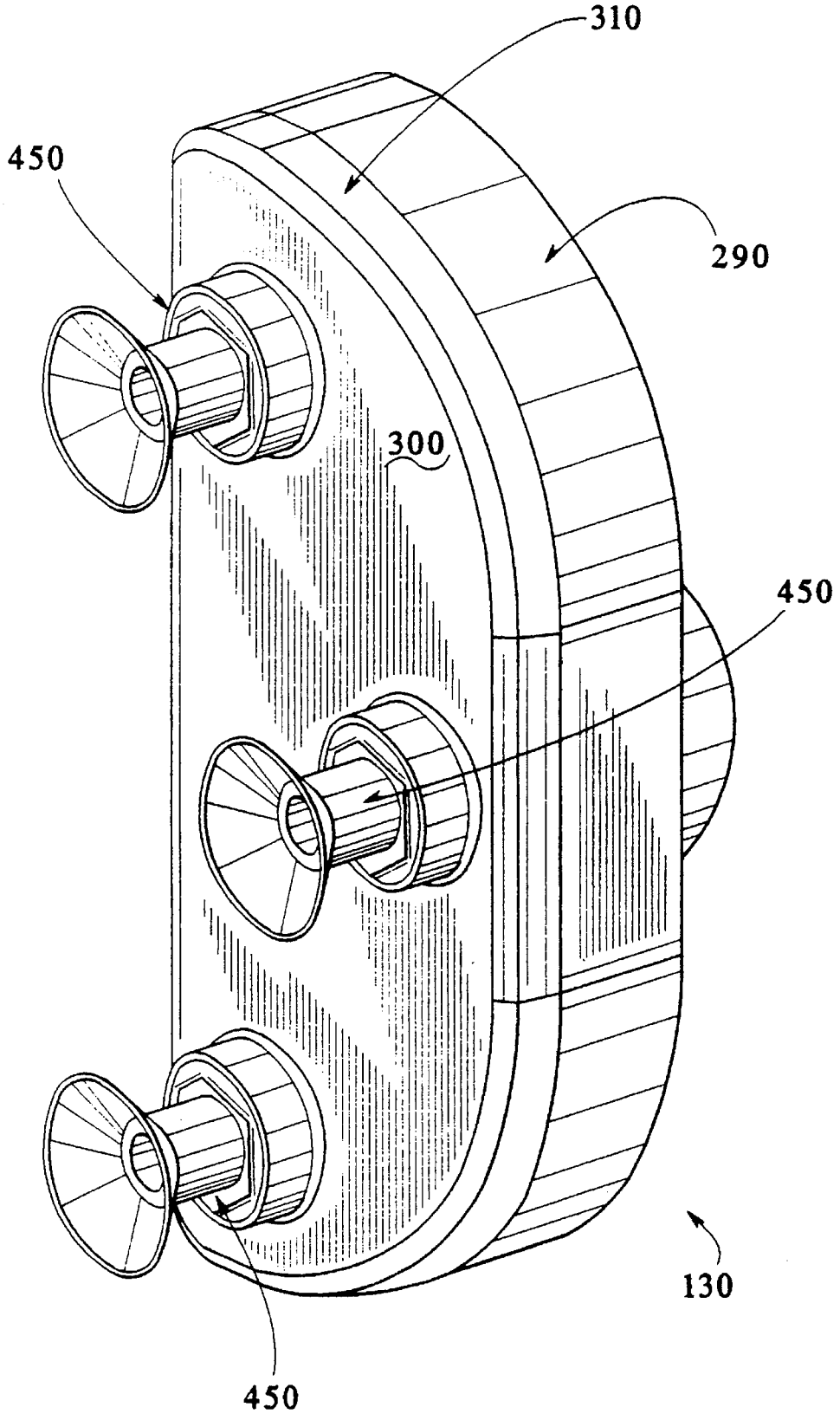
Figure 6:
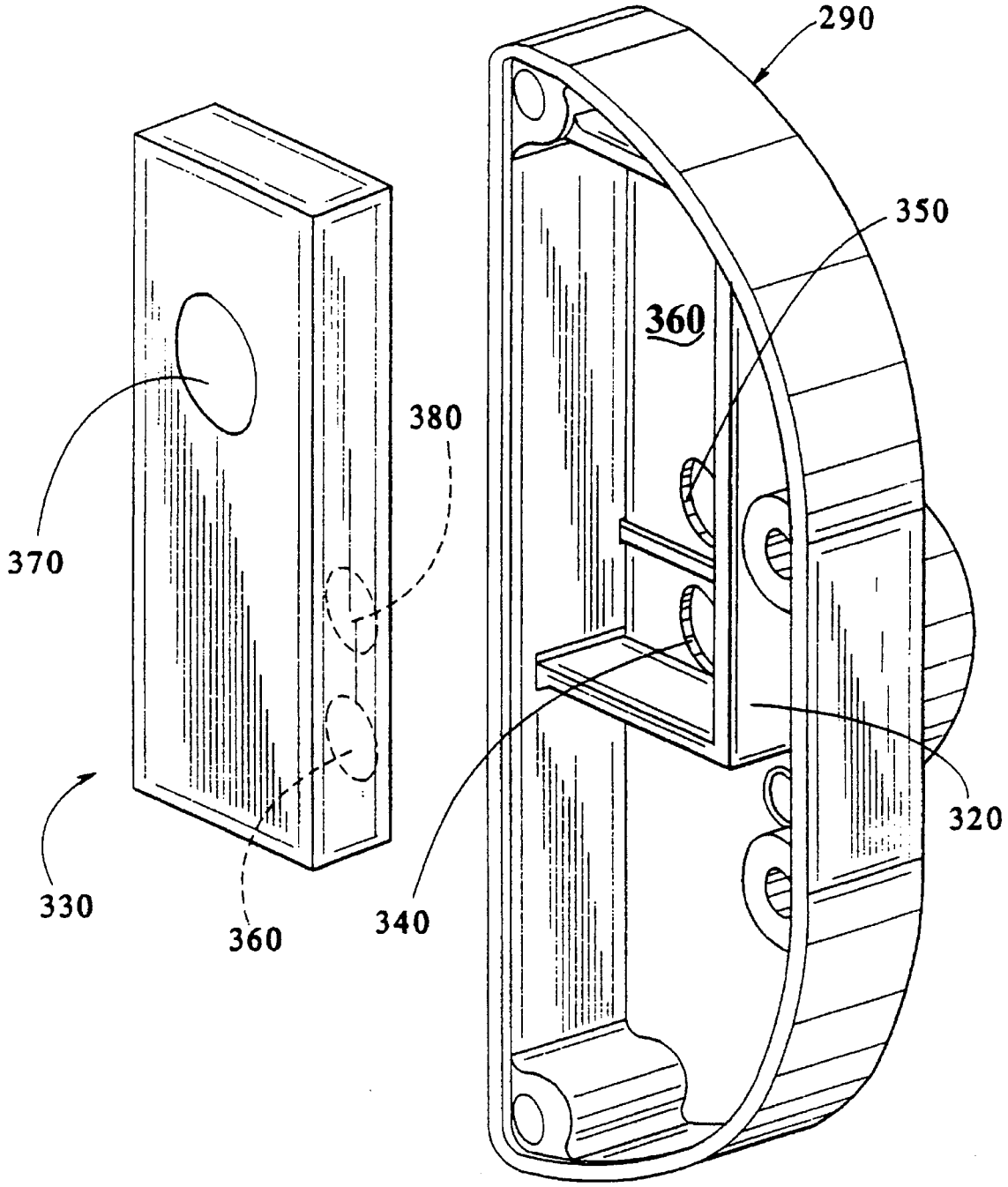
Figure 9:
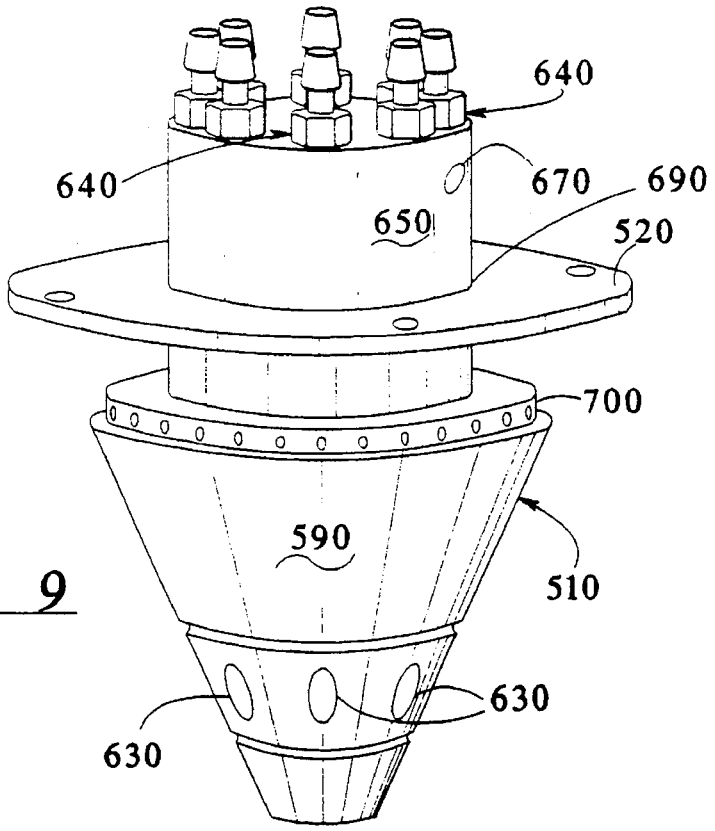
FIGS. 9–12 illustrate one embodiment of a valve assembly suitable for use in the apparatus of FIG. 1.

As illustrated in FIGS. 2A and 2B, the follower arm 135 includes a follower 140 that engages a cam track 150 (see FIG. 1) of the guide member 90. The follower 140 is disposed at the joint between two lever arms 142 and 144. Lever arm 142 proceeds between follower 140 and the picking arm shaft 119 while lever arm 144 proceeds between the follower 140 and connecting arm 146 that connects lever arm 144 to the hub assembly 30 by a pin 147.

A plurality of gas hoses 160 extend from the valve mechanism 60 and are used to supply compressed gas from the valve assembly 60 to each vacuum manifold assembly 130. These compressed gas hoses 160 extend through the interior of the hollow shaft 40 and, as will be set forth below, proceed through a plurality of apertures disposed in the hub assembly 30 to each engage a compressed gas inlet of a respective vacuum manifold assembly 130.

FIGS. 3 and 4 are top and bottom perspective views of the hub assembly 30. As illustrated, the hub assembly 30 is in the form of a disk and includes a shell 170 having a hollow interior portion and a weighted perimeter 172, a centrally disposed hub 180 in the hollow interior portion of the shell 170, and a plurality of ribs 190 extending radially from the hub 180 in the interior portion of the shell 170. The hub 180 includes a centrally disposed aperture 200 and a threaded portion 210 that engages the top of the hollow shaft 40 which likewise has a corresponding threaded top portion. A plurality of apertures 220 are disposed through the sidewalls of the hub 180 and a further corresponding set of apertures 230 are disposed through the shell 170. The gas hoses 160 extending through the hollow shaft 40 pass through apertures 220 and 230 to engage their respective vacuum manifold assemblies 130.

Generally circular mounting members 240 extend from the upper face of the shell 170 about each hose aperture 230. A plurality of fastening apertures 250 are disposed about each hose aperture 230 of each mounting member 240. A protective sheath 115, as illustrated in FIG. 1, is disposed over each gas hose 160 and is connected between each mounting member 240 and the rear of each vacuum manifold assembly 130 to protect the respective hose. The sheath 260 may be connected to mounting members 240 by fasteners, such as screws, that engage sheath 260 and fastening aperture 250.

A plurality of shaft apertures 270 extend through the shell 170 and expanded portions 280 of the ribs 190. The shaft apertures 270 engage the picking arm shafts 119. Pin apertures 275 engage the pin 146 of each respective follower arm 135.

FIGS. 5–8 illustrate the vacuum manifold assembly 130 and its various component parts. The vacuum manifold assembly 130 includes a first housing portion 290, a second housing portion 300, and an intermediate wall 310 separating the first and second housing portions 290 and 300. The first housing portion 290 includes an interiorly disposed wall 320 that defines a holding chamber for holding a vacuum generating device 330, such as, for example, a Venturi device. An inlet aperture 340 and an exhaust aperture 350 are disposed through the rear wall 360 of the first housing portion 290 in the region of the holding chamber to facilitate in providing compressed gas to the vacuum generating device 330 and, further, to facilitate in providing an outlet for gas that is exhausted from the vacuum generating device 330. The inlet and exhaust apertures 340 and 350 are disposed along parallel axes and, further, are co-planar.

The inlet aperture 340 may be fit with a nozzle that interconnects the respective compressed gas hose 160 with the inlet of the vacuum generating device 330. The vacuum generating device 330 may be a Venturi device such as one of Model Nos. L15 or L30 Vakuumchips available from PIAB that is modified so that the outlet for exhaust gas is on an axis parallel with the axis of the inlet that receives compressed gas through the respective gas hose 160. The Venturi device accepts compressed gas at its inlet 360 and creates a vacuum force at a vacuum outlet 370 that is disposed through a sidewall of the Venturi device opposite the inlet 360 and exhaust 380.

The second housing portion 300 is illustrated in FIG. 7. The second housing portion 300 includes an interiorly disposed wall 390 that defines a manifold chamber 400. Three suction cup apertures 410, 412, 414 are provide through the fore wall 420 of the second housing portion 300 and are arranged at apices of a triangular formation. The vacuum manifold chamber 400 includes a first manifold sub-chamber 430 that extends between two of the suction cup apertures 410 and 414. A second manifold sub-chamber 440 extends from and is transverse to the first vacuum manifold sub-chamber 430. The second manifold sub-chamber 440 facilitates fluid communication between the first vacuum manifold sub-chamber 430 and the suction cup aperture 412. The suction cup apertures 410, 412, 414 may be provided with suction cup assemblies 450. The suction cup assemblies 450 are thus in fluid communication with the vacuum outlet 370 of the vacuum generating device 330 via the vacuum manifold chamber 400.

The intermediate wall 310 is illustrated in FIG. 8. An aperture 460 is disposed through the intermediate wall 310 in a region that is proximate the vacuum outlet 370 of the Venturi device 330 when the intermediate wall 310 is assembled with the first housing portion 290. The aperture 460 facilitates fluid communication between the vacuum outlet 370 of the vacuum generating device 330 and the vacuum manifold chamber 400. Gaskets may be placed at various locations within the assembly 130 to ensure more efficient operation.

In operation, compressed gas is supplied at the inlet of the vacuum manifold assembly 130. The compressed gas flows to the inlet 360 of the Venturi device 330 where it is used to create a vacuum at vacuum outlet 370. Exhaust gas exits from the aperture 380 to the exhaust aperture 350 of the first housing portion 290. The exhaust aperture 350 may be provided with a silencer. The vacuum generated by the Venturi device 330 is communicated between the first housing portion 290 and the vacuum manifold chamber 400 of the second housing portion 290 by virtue of the aperture 460 disposed in the intermediate wall 310. The vacuum manifold chamber 400 assists in providing communication of the vacuum to each of the suction cup assemblies 450 which, in turn, grip a workpiece such as a carton blank.

FIGS. 9–12 illustrate the various components of the valve assembly 60. As illustrated, the valve assembly 60 includes a housing 500, a distribution member 510, a cover plate 520, a flange plate 525, and a spring 530. In the exemplary embodiment, the distribution member 510 may be formed of Teflon while the spring 530, plate 520 and housing 500 may be formed from stainless steel.

The housing 500 includes a generally conical interior chamber 540 and a distribution chamber 550. The distribution chamber 550 proceeds about less than the full circumference of the conical interior chamber 540. The distribution chamber 550 is, further, in fluid communication with a fluid supply channel 560 which is disposed through the sidewall of the housing 500 and that, for example, receives a compressed gas from the compressed gas line 80. Two pressure relief apertures 570 and 580 are disposed through the sidewall of the housing 500 in locations above and below the position of the distribution chamber 550.

The distribution member 510 is disposed at least partially in the conical interior chamber 540 of the housing 500 and includes a generally conical nose portion 590 that conforms to the conical interior chamber 540 of the housing 500. The conical nose portion 590 extends through a nose aperture 600 disposed through the bottom wall 610 of the housing 500.

A plurality of fluid communication channels 620 proceed through the distribution member 510. Each of the fluid communication channels 620 includes a respective fluid inlet 630 and a fluid outlet 640. The fluid inlets 630 are disposed about the circumference of the conical nose portion 590 of the distribution member 510 at a vertical position corresponding with the vertical position of the distribution chamber 55. The fluid outlets 640 are disposed at the top of a cylindrical portion 650 that extends from the top of the conical nose portion 590 of the distribution member 510. In the illustrated embodiment, the fluid outlets 640 include quick-connect nozzles that connect to the compressed gas hoses 160 that extend through the hollow shaft 40. Pressure relief channels 660 are disposed above and below the fluid inlet apertures 630 at vertical positions coinciding with the pressure relief apertures 570 of the housing 580.

A shaft aperture 670 is disposed in the cylindrical portion 650 of the distribution member 510. The shaft aperture 670 of the exemplary embodiment engages, for example, a rod that, in turn, engages the hollow shaft 40. This engagement facilitates co-rotation of the hollow shaft 40 and the distribution member 510. Alternatively, in instances where the hollow shaft 40 is in a fixed position, the cylindrical portion 650 may directly or indirectly engage, for example, a gear or timing belt whose motion is coordinated with the rotation of the hub assembly 30.

Figure 10:
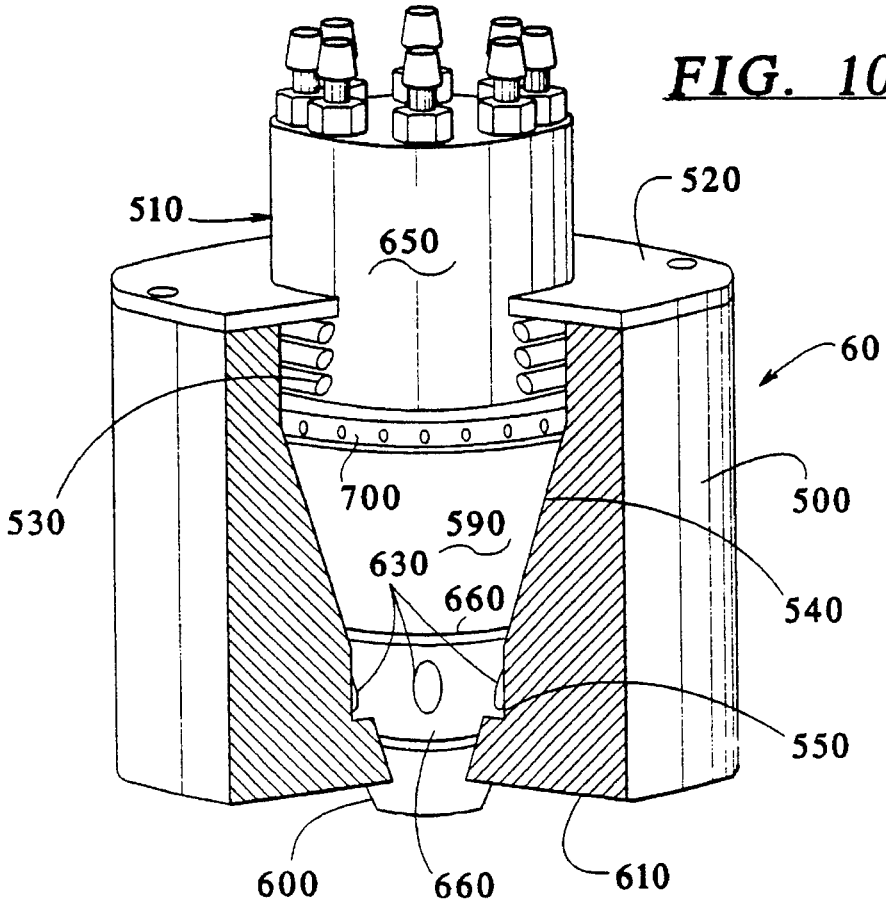
Figure 11:
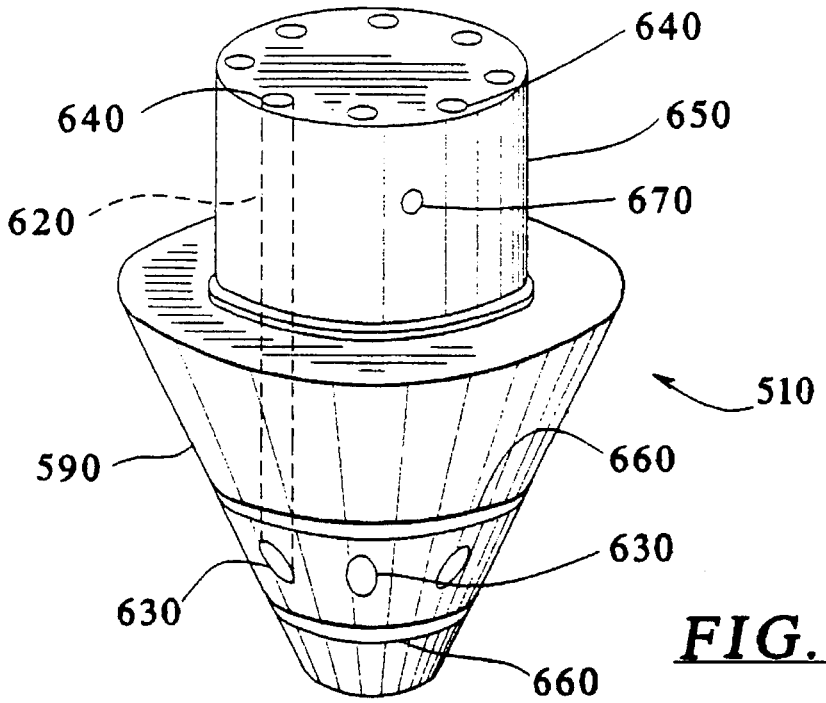
Figure 12:
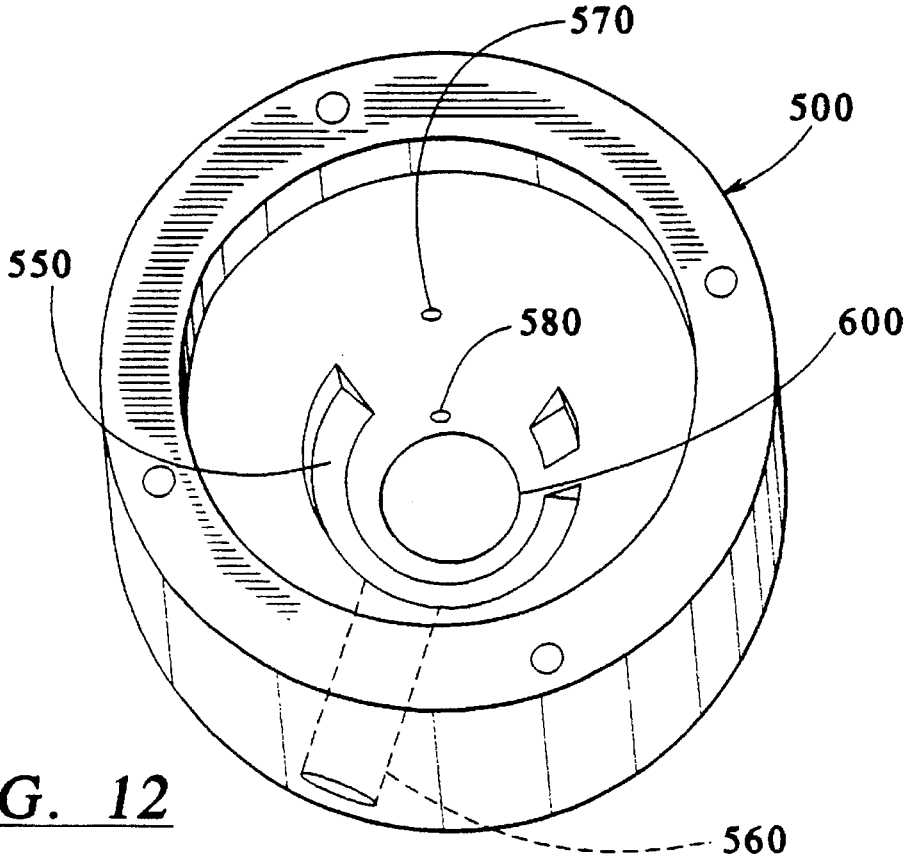
Figure 17:
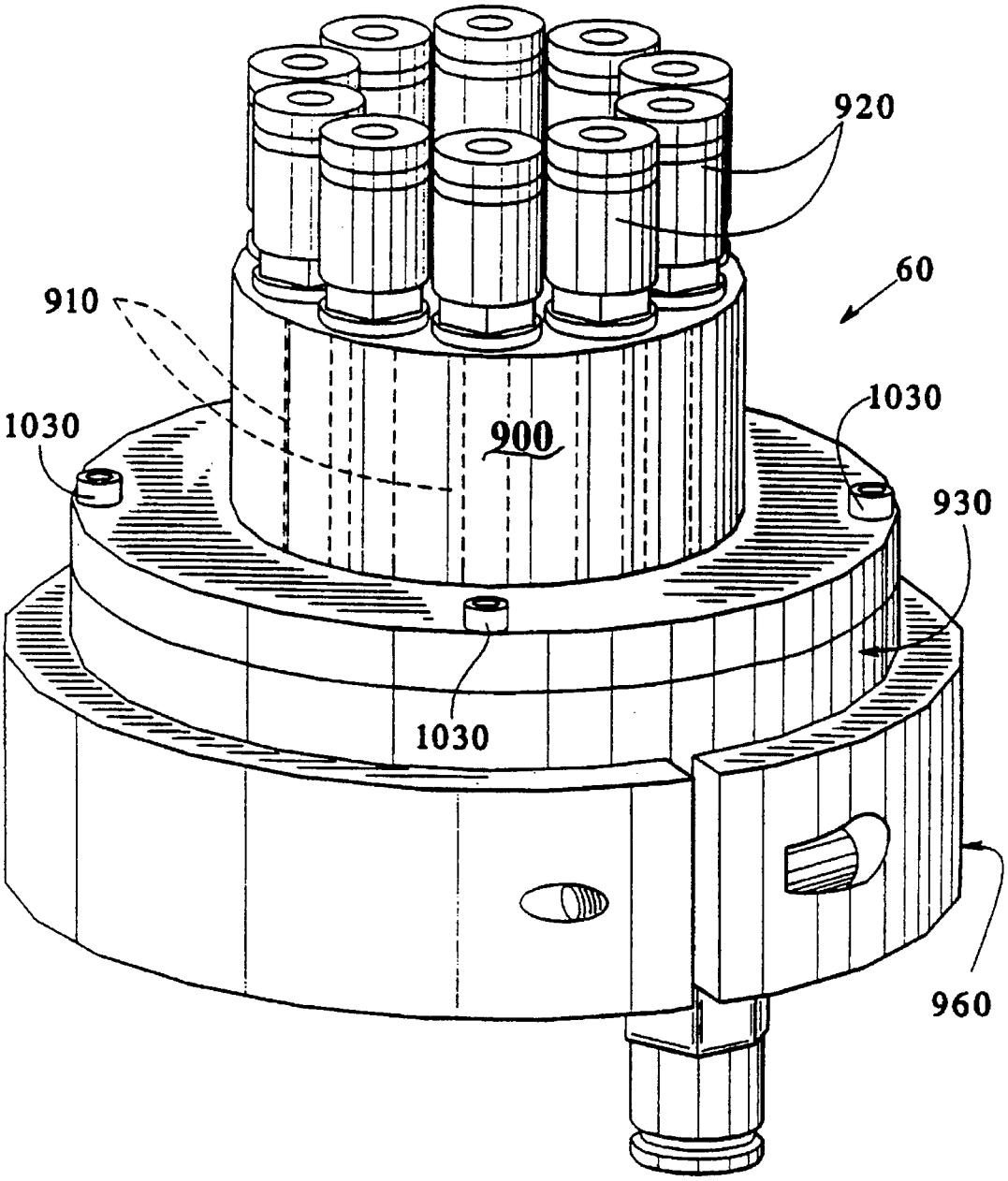
FIGS. 17–21 illustrate a further ebodiment of a valve assembly suitable for use in the apparatus of FIG. 1.
Figure 18:
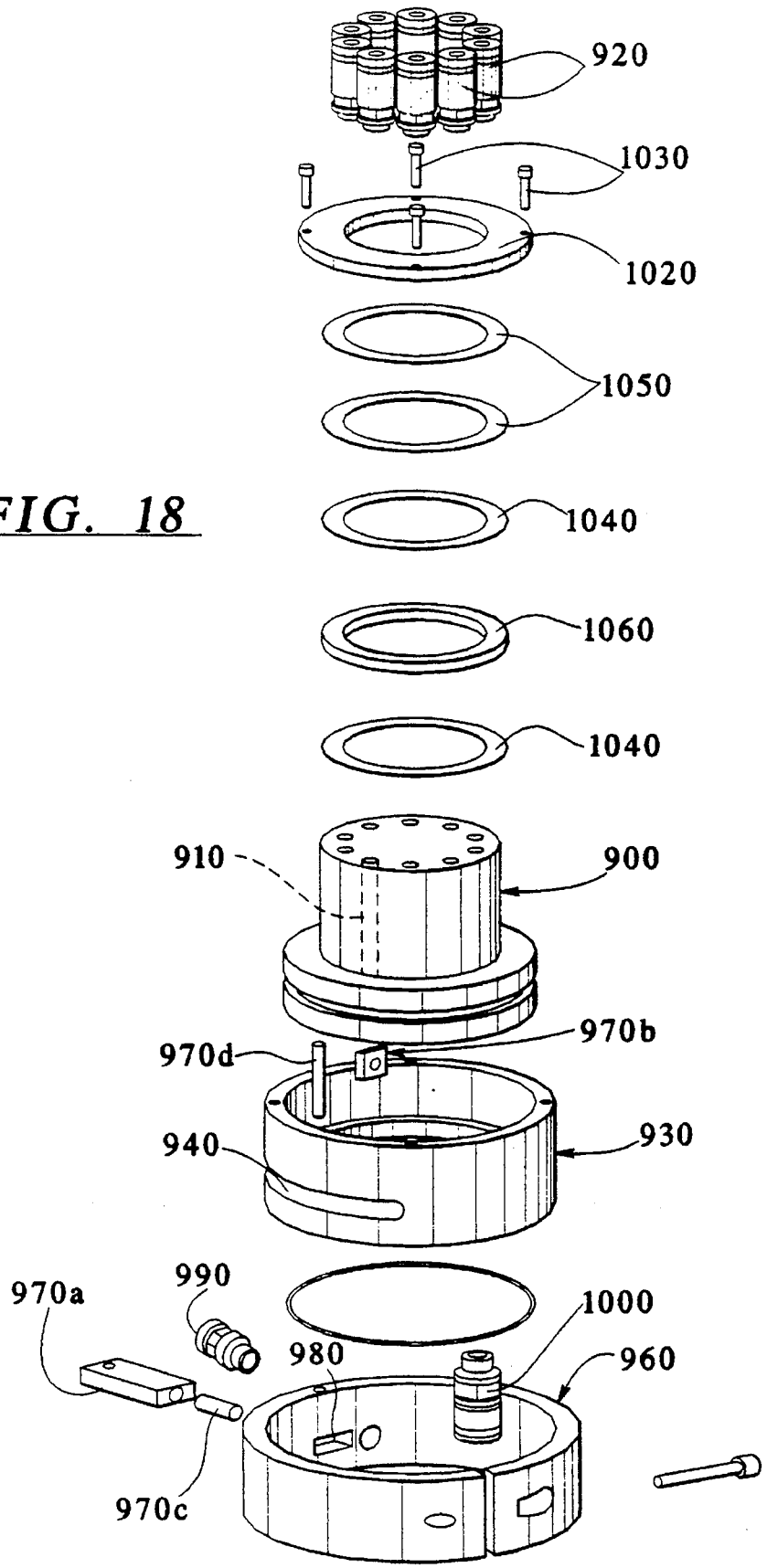
Figure 19:
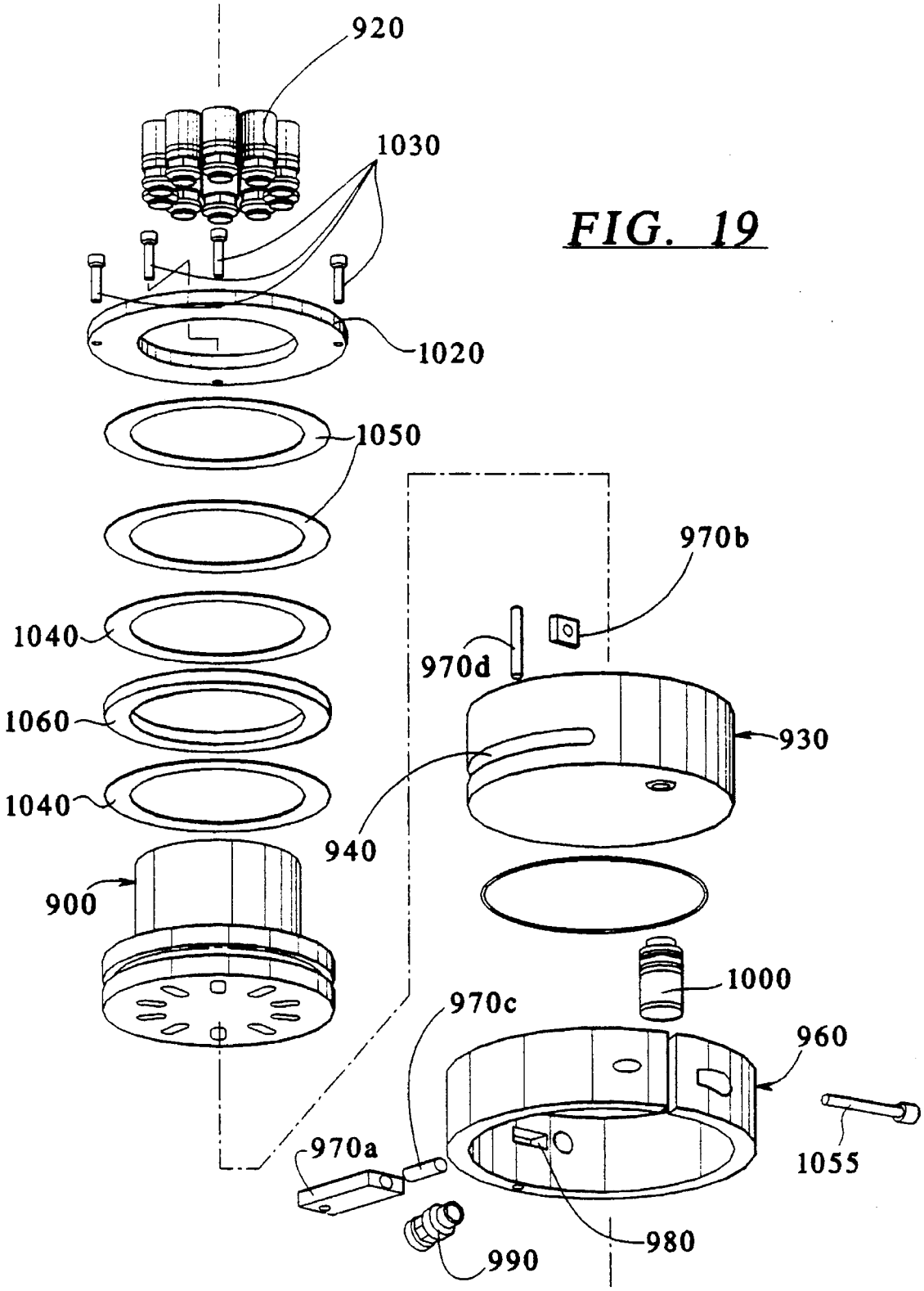

FIG. 10 illustrates the relative positions of the components when they are assembled to form the valve assembly 60. As illustrated, the cylindrical portion 650 of the distribution member 510 extends through an aperture 690 of the cover plate 520. The cover plate 520 is secured to the housing 500 by, for example, screw fasteners that extend about the upper rim of the housing 510. The spring 530 is disposed about the cylindrical portion 655 between the cover plate 520 and the flange plate 525 disposed about the cylindrical portion 650 of the distribution member 510.

In operation of this exemplary valve assembly 60, the housing 500 is disposed in a fixed position at the base of the hollow shaft 40 while the distribution member 510 is disposed for co-rotation with the hollow shaft 40, for example, in the manner previously described. As the hollow shaft 40, hub assembly 30, and distribution member 510 rotate, only several of the inlet apertures 630 at any given time are placed in fluid communication with the compressed gas that is received through the fluid inlet channel 560. As a result, only selected ones of the vacuum manifold assemblies 130 receive the compressed gas necessary to generate a vacuum. The vacuum manifold assemblies 130 that receive compressed gas vary sequentially as the distribution member 510 rotates. This sequential supply of compressed gas facilitates the sequential application of vacuum pressure that is required to pick, transfer, and release the carton blank as it is transferred from, for example, a carton blank magazine, to, for example, a conveyor. The selective supply of the compressed gas to the vacuum manifold assemblies 130 is in synchronism with the movement of the picking arm assemblies 110 on the hub assembly 30.

As the distribution member 510 rotates, the housing 500 and the distribution member 510 are subject to wear due to the frictional forces between the two. The degree of wear can be determined from a visual inspection of the conical nose portion 590 of the distribution member 510 that extends through the aperture 600 at the bottom wall 610 of the housing 500. Maintenance can be scheduled based on the amount of the conical portion 590 extending through the aperture 600. When the conical portion 590 extends though the aperture 600 a predetermined amount, maintenance is necessary. Further, the nature of the wear of the conical nose portion 590 extending through the aperture 600 can be used to determine whether it is the distribution member 510 or housing 500 that needs maintenance.

Those skilled in the art will recognize that the particular embodiment of the valve assembly described herein can also be used to distribute a vacuum under pressure to a plurality of devices. The valve assembly thus has applications beyond those described herein.

The apparatus 20 may be mechanically driven in synchronism with a conveyor assembly. In such instances, the conveyor assembly would include a conveyor belt supporting a plurality of carriers that engage carton blanks. Two drive wheels engage the conveyor belt. The first drive wheel may include a drive shaft that engages a timing belt that, in turn, drives hollow shaft 40 and a drive second wheel may engage the perimeter of the hub assembly 30. Alternatively, the timing belt may engage the cylindrical portion 650 of the distribution member 510. The timing belt, for example, may be driven by a servomotor. Other drive mechanisms are likewise suitable for driving the hub assembly 30 and the valve assembly 60.

In operation, the suction cups of the picking assemblies engage carton blanks disposed in, for example, a magazine. The picking assemblies 110 rotate about rotation axis 100 along a closed path and transfer the cannon blanks to the conveyor assembly. As the hub rotates the cam track 150 of the guide member 90 controls the movement of the picking assembly 110 via the respective follower arm 135 to erect the carton blank during this transfer.

FIGS. 13 and 14 illustrate an alternative embodiment of the picking arm 117. In this embodiment, the picking arm includes a mounting member 800 including a body portion 805 that is shaped for engagement with corresponding apertures in the hub 30 and a flange 810 disposed about the body portion 805 and including mounting apertures 815 through which fasteners, for example, screws or bolts, secure the flange 810 and body portion 805 to the hub assembly 30.

A picking arm shaft 820 extends through the body portion 805 to engage a follower arm 825 and corresponding follower 830. The follower arm 825 is secured for pivotal movement about the shaft 820. Follower 830 is disposed for rotation about a pivot pin 835 and engages the cam track 150. Arms 840 extend from the upper portion of shaft 820 and, for example, include grasping members 850 (FIG. 2) disposed for pivotal movement about axis 860. Arms 840, follower arm 825, and mounting member 800 may all be formed from, for example Ryton (polyphenylene sulfide based plastic).

Arms 840 assist in grasping and erecting a carton that is picked from a blank magazine. Erection of the carton blanks may be facilitated by an apparatus constructed in accordance with the teachings of U.S. Ser. No. 08/315,406, entitled "Cam Mechanism for Bending Carton Blanks Fed From The Magazine Of A Packaging Machine", and U.S. Ser. No. 08/317,385, entitled "Vacuum Assisted Gate Assembly For The Carton Blank Magazine Of A Packaging Machine", both of which are filed on even date herewith and incorporated by reference.

FIGS. 15 and 16 illustrate the picking arm 117 of FIGS. 13 and 14 as mounted to an alternative embodiment of the hub assembly 30. In this hub embodiment, the hub assembly may be formed from spun sheet metal and includes a hollow hub portion 880 and a shell portion 890. The vacuum manifold assemblies 130 are connected to the hub portion 880 without an intermediate sheath. The hoses 160 thus proceed through the hollow portion of the hub portion and into engagement with the respective manifold assembly 30.

Figure 20:
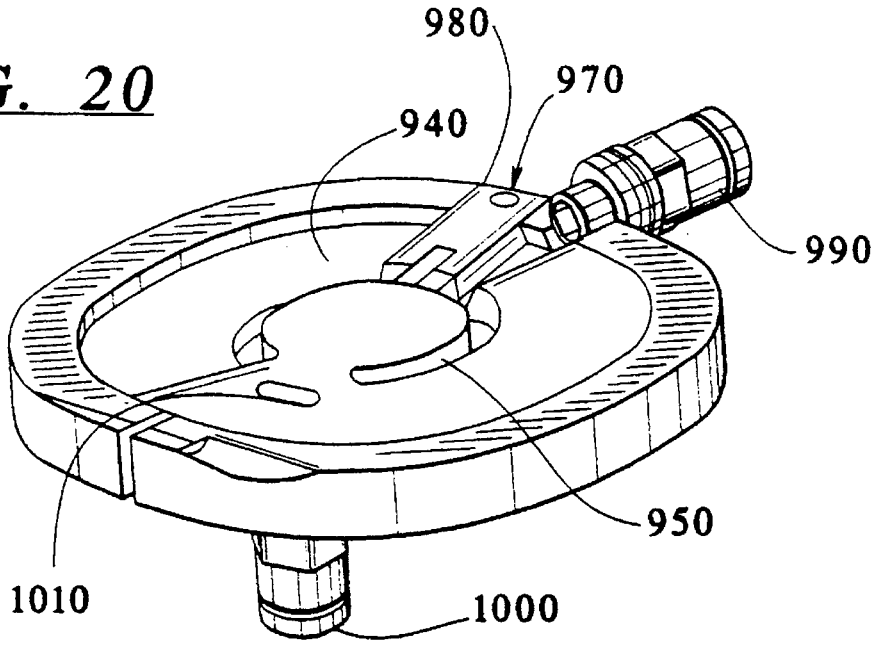
Figure 21:
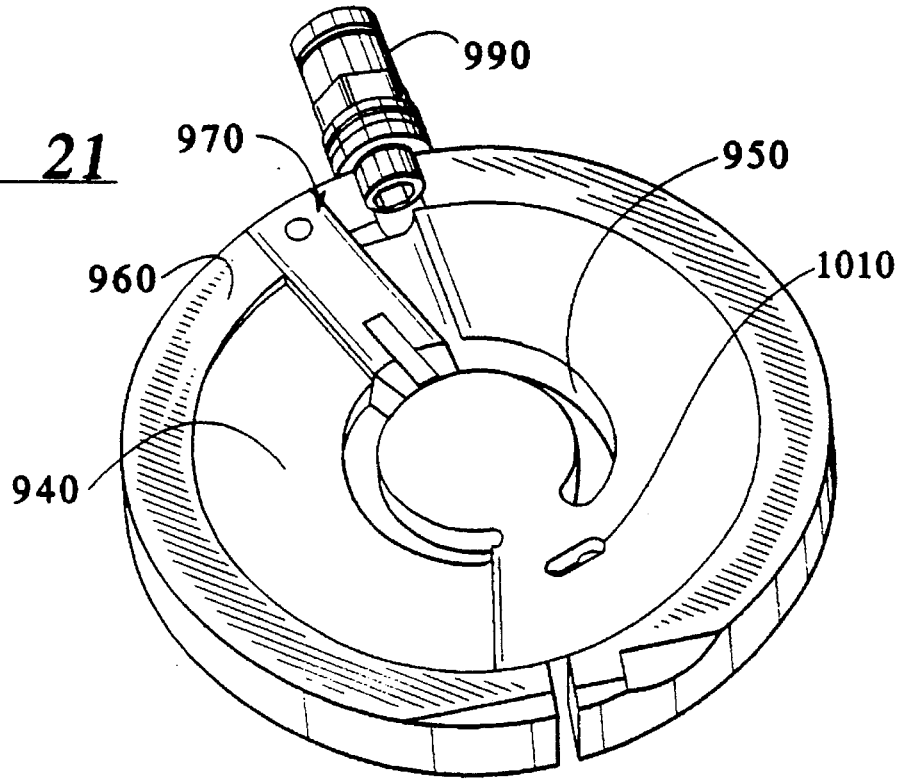

FIGS. 17–21 illustrate an alternative embodiment of the valve mechanism 60. As illustrated, the valve mechanism 60 includes a rotary valve body 900 having a plurality of air channels 910 disposed therethrough. At a top portion of the valve body 900, there are a plurality of quick connectors 920 respectively associated with each channel 910 and which are adapted for releasable connection with hoses 160 (FIG. 1). The valve body 900 is disposed within a housing 930 that includes a plug channel 940 that positionally coincides with a distribution channel 950 (FIGS. 20 and 21). An adjustment clamp 960 is disposed about the housing 930 and includes a plug member 970 that extends through a corresponding aperture 980 in the sidewall of the adjustment clamp 960 and into the plug channel 950. A primary air supply connector 990 is disposed through a sidewall of the adjustment clamp 960 and is connected to a primary air supply. The adjustment clamp 960 may be rotated about the housing 930 to alter the effective length of the distribution channel 950 that, in turn, is in fluid communication with the channels 910 of the valve body as it rotates with respect to the housing 930. This facilitates control of the air supply so that each of the vacuum assemblies is provided with a supply of air only along an angular path that is adjustable by the user.

A secondary air supply connector 1000 is disposed beneath the housing 930 and provides fluid communication between a secondary air supply and a picking chamber 1010. The picking chamber 1010 is disposed at a position to control air flow to each of the vacuum assemblies 130 as each vacuum assembly is at a position at which it is picking a blank from a magazine. In this manner, picking of the blanks may be prevented without altering the supply of air to the vacuum assemblies 130 as they proceed along the angular path that has been set by the user.

Other components of the valve assembly 60 include a cover 1020, fasteners 1030, thrust washers 1040, spring washers 1050, adjustment screw 1055, and needle bearing 1060. The housing, for example, may be made from stainless steel while the rotary valve 900 may be made from Wolf plastic.

Although the present invention has been described with reference to a specific embodiment, those of skill in the art will recognize that changes may be made thereto without departing from the scope and spirit of the invention as set forth in the appended claims.

We claim as our invention:

1. An apparatus for transferring a workpiece, the apparatus comprising:

(a) plurality of picking assemblies that are movable along a closed transfer path, each of the picking assemblies comprising i. a vacuum manifold assembly, the vacuum manifold assembly including an input for receiving compressed gas;

ii. vacuum generating means disposed in the vacuum manifold assembly for generating a vacuum from compressed gas received at the input of the vacuum manifold assembly;

iii. at least on suction cup in fluid communication with the vacuum generated by the vacuum generating means; and (b) valve means for controlling the flow of the compressed gas to the plurality of picking assemblies, the valve means controlling the flow of the compressed gas in synchronism with movement of the plurality of picking assemblies so that each of the picking assemblies is cyclically supplied with compressed gas along only a portion of the closed transfer path.

2. An apparatus as claimed in claim 1 wherein the apparatus includes at least three suction cups.

3. An apparatus as claimed in claim 1 wherein the valve means comprises:

a housing having a generally conical interior chamber and a distribution chamber, the distribution chamber proceeding about less than the full circumference of the conical interior chamber and being in fluid communication with a fluid supply channel, the fluid supply channel being disposed through sidewalls of the housing; and a distribution member connected for synchronous movement with the plurality of picking assemblies along the closed transfer path, the distribution member disposed at least partially in the conical interior chamber of the housing and having a generally conical nose portion conforming to the conical interior chamber, the distributor member and the housing being disposed for relative rotation with one another, the distribution member having a plurality of fluid communication channels formed therein, each of the fluid communication channels having a fluid inlet and a fluid outlet, the fluid inlets of the plurality of fluid communication channels, being disposed along the circumference of the conical nose portion at a position coinciding with the distribution chamber, relative rotation of the housing and the distribution member causing selective fluid communication between selected ones of the plurality of fluid communication channels and the distribution chamber.

4. An apparatus as claimed in claim 1 wherein the workpiece is a carton blank and a portion of the closed transfer path extends between a supply of carton blanks and a conveyor that accepts the carton blanks.

5. An apparatus as claimed in claim 4 wherein the valve means supplies compressed gas only along the portion of the closed transfer path between the supply of carton blanks and the conveyor.

6. An apparatus for transferring a workpiece, the apparatus comprising:

a plurality of picking assemblies that are movable along a closed transfer path, each of the picking assemblies comprising vacuum generating means for generating a vacuum from a compressed gas, the vacuum generated by the vacuum generating means being operable to allow the respective picking assembly to vacuum grip the workpiece when the respective picking assembly is supplied with the compressed gas; and valve means for controlling the flow of compressed gas to the plurality of picking assemblies, the valve means controlling the flow of the compressed gas in synchronism with movement of the plurality of picking assemblies so that each of the picking assemblies is cyclically supplied with compressed gas along only a portion of the closed transfer path.

7. An apparatus for transferring a workpiece; the apparatus comprising:

a plurality of picking assemblies that are movable along a closed transfer path, each of the picking assemblies comprising vacuum generating means for generating a vacuum from a compressed gas, the vacuum generated by the vacuum generating means being operable to allow the respective picking assembly to vacuum grip the workpiece when the respective picking assembly is supplied with the compressed gas; and valve means for controlling the flow of compressed gas to the plurality of picking assemblies, the valve means controlling the flow of the compressed gas in synchronism with movement of the plurality of picking assemblies so that each of the picking assemblies is cyclically supplied with compressed gas along only a portion of the closed transfer path.

8. An apparatus as claimed in claim 7 wherein the valve means comprises:

a housing having a generally conical interior chamber and a distribution chamber, the distribution chamber proceeding about less than the full circumference of the conical interior chamber and being in fluid communication with a fluid supply channel, the fluid supply channel being disposed through sidewalls of the housing; and a distribution member connected for synchronous movement with the plurality of picking assemblies along the closed transfer path, the distribution member disposed at least partially in the conical interior chamber of the housing and having a generally conical nose portion conforming to the conical interior chamber, the distributor member and the housing being disposed for relative rotation with one another, the distribution member having a plurality of fluid communication channels formed therein, each of the fluid communication channels having a fluid inlet and a fluid outlet, the fluid inlets of the plurality of fluid communication channels being disposed along the circumference of the conical nose portion at a position coinciding with the distribution chamber, relative rotation of the housing and the distribution member causing selective fluid communication between selected ones of the plurality of fluid communication channels and the distribution chamber.

9. An apparatus as claimed in claim 8 wherein the first housing portion includes an exhaust aperture substantially co-planar with the input aperture.

10. An apparatus as claimed in claim 9 wherein the exhaust aperture and the input aperture are disposed along generally parallel axes.

11. An apparatus as claimed in claim 8 wherein the vacuum generating means is a Venturi device having an inlet for receiving the compressed gas and an exhaust, the inlet and exhaust being disposed along generally parallel axes.

12. An apparatus as claimed in claim 8 wherein the apparatus includes at least three suction cups and wherein the second housing portion includes at least three suction cup apertures that facilitate providing fluid communication between the vacuum manifold chamber and the at least three suction cups.

13. An apparatus as claimed in claim 12 wherein the vacuum manifold chamber comprises:

a first vacuum subchamber extending between two of the at least three suction cups; and a second vacuum subchamber extending from and transverse to the first vacuum chamber and providing fluid communication between the first vacuum chamber and a third suction cup of the at least three suction cups.

14. An apparatus as claimed in claim 7 wherein the compressed gas is compressed air.

15. An apparatus as claimed in claim 7 and further comprising a vacuum manifold assembly, the vacuum generating means being disposed in the vacuum manifold assembly.

16. An apparatus as claimed in claim 15 wherein the vacuum manifold assembly comprises:

a first housing portion including a chamber for holding the vacuum generating means, the first housing portion having an input aperture to facilitate in providing the compressed gas to an input of the vacuum generating means;

a second housing portion including a vacuum manifold chamber in fluid communication with at least one suction cup, the at least one suction cup operable to grip a workpiece upon application of a vacuum to the suction cup; and an intermediate wall disposed between the first and second housing portions, the intermediate wall having an aperture to provide fluid communication between the vacuum manifold chamber and a vacuum output of the vacuum generating means.

17. An apparatus as claimed in claim 16 wherein the first housing portion includes an exhaust aperture substantially co-planar with the input aperture.

18. An apparatus as claimed in claim 16 wherein the first housing portion includes an exhaust aperture, the exhaust aperture and the input aperture being disposed along generally parallel axes.

19. An apparatus as claimed in claim 16 wherein the vacuum generating means is a Venturi device having an inlet for receiving the compressed gas and an exhaust, the inlet and exhaust being disposed along generally parallel axes.

20. An apparatus as claimed in claim 16 wherein the apparatus includes at least three suction cups and wherein the second housing portion includes at least three suction cup apertures that facilitate providing fluid communication between the vacuum manifold chamber and the at least three suction cups.

21. An apparatus as claimed in claim 20 wherein the vacuum manifold chamber comprises:

a first vacuum subchamber extending between two of the at least three suction cups; and a second vacuum subchamber extending from and transverse to the first vacuum chamber and providing fluid communication between the first vacuum chamber and a third suction cup of the at least three suction cups.

22. An apparatus as claimed in claim 7 wherein the valve means comprises:

a housing having a generally conical interior chamber and a distribution chamber, the distribution chamber proceeding about less than the full circumference of the conical interior chamber and being in fluid communication with a fluid supply channel, the fluid supply channel being disposed through sidewalls of the housing; and a distribution member connected for synchronous movement with the plurality of picking assemblies along the closed transfer path, the distribution member disposed at least partially in the conical interior chamber of the housing and having a generally conical nose portion conforming to the conical interior chamber, the distributor member and the housing being disposed for relative rotation with one another, the distribution member having a plurality of fluid communication channels formed therein, each of the fluid communication channels having a fluid inlet and a fluid outlet, the fluid inlets of the plurality of fluid communication channels being disposed along the circumference of the conical nose portion at a position coinciding with the distribution chamber, relative rotation of the housing and the distribution member causing selective fluid communication between selected ones of the plurality of fluid communication channels and the distribution chamber.

23. An apparatus for picking and transferring a carton blank, the apparatus comprising:

a hub assembly;

a hollow shaft connected for co-rotation with the hub assembly;

a plurality of picking assemblies connected to the hub assembly for rotation with the hub assembly along a closed transfer path, each of the picking assemblies comprising vacuum generating means for generating a vacuum from the compressed gas, the vacuum being operable to allow the picking assembly to vacuum grip the workpiece when the picking assembly is supplied with the compressed gas;

a plurality of gas hoses extending through the hollow shaft and connected to supply the compressed gas to respective ones of the plurality of picking assemblies; and a valve mechanism for controlling the flow of compressed gas through the plurality of gas hoses to the plurality of picking assemblies, the valve mechanism controlling the flow of the compressed gas in synchronism with rotation of hub assembly so that each of the picking assemblies is sequentially supplied with compressed gas along only a portion of the closed transfer path.

24. An apparatus as claimed in claim 23 wherein the hub assembly comprises:

a shell having a hollow interior portion and a plurality of mounting portions for mounting the picking assemblies thereto;

a hub disposed in the hollow interior portion of the shell at a central portion of the shell; and a plurality of radial arms extending from the hub in the interior hollow portion of the shell.

25. An apparatus as claimed in claim 24 wherein the shell includes a plurality of hose apertures for accepting the gas hoses therethrough.

26. An apparatus as claimed in claim 25 wherein the hub includes a plurality of hose apertures for accepting the gas hoses therethrough.

27. An apparatus as claimed in claim 24 wherein the shell includes a weighted perimeter portion disposed about the circumference thereof.

28. An apparatus as claimed in claim 23 wherein each of the plurality of picking assemblies comprises:

a rigid sheath connected to the hub assembly; and a vacuum manifold assembly connected to the rigid sheath and housing the vacuum generating means, the vacuum manifold assembly including at least on suction cup in fluid communication with the vacuum generated by the vacuum generating means.

29. An apparatus as claimed in claim 28 and further comprising a picking arm respectively associated with each of the picking assemblies, the picking arm comprising:

a shalt connected to the hub assembly;

at least one transverse arm extending from the shaft at a portion of the shalt extending above the hub assembly;

a follower arm assembly connected to the shaft at a portion of the shaft extending below the hub assembly.

30. An apparatus as claimed in claim 29 wherein the at least one transverse arm is formed from a plastic material that is molded to the shaft.

31. An apparatus as claimed in claim 28 and further comprising a guide member disposed proximate the hub assembly, the guide member having a guiding cam track disposed therein that engages the follower arm.

32. An apparatus as claimed in claim 28 wherein the vacuum manifold assembly comprises:

a first housing portion including a chamber for holding the vacuum generating means, the first housing portion having an input aperture to facilitate in providing the compressed gas to an input of the vacuum generating means;

a second housing portion including a vacuum manifold chamber in fluid communication with the at least one suction cup; and an intermediate wall disposed between the first and second housing portions, the intermediate wall having an aperture to provide fluid communication between the vacuum manifold chamber and a vacuum output of the vacuum generating means.

33. An apparatus as claimed in claim 28 wherein the apparatus includes at least three suction cups.

34. An apparatus as claimed in claim 33 wherein the vacuum manifold chamber comprises:

a first vacuum subchamber extending between two of the at least three suction cups; and a second vacuum subchamber extending from and transverse to the first vacuum chamber and providing fluid communication between the first vacuum chamber and a third suction cup of the at least three suction cups.

35. An apparatus as claimed in claim 28 wherein the apparatus includes at least three suction cups and wherein the second housing portion includes at least three suction cup apertures that facilitate providing fluid communication between the vacuum manifold chamber and the at least three suction cups.

36. An apparatus as claimed in claim 23 wherein the compressed gas is compressed air.

37. An apparatus as claimed in claim 36 wherein the first housing portion includes an exhaust aperture substantially co-planar with the input aperture.

38. An apparatus as claimed in claim 36 wherein the first housing portion includes an exhaust aperture, the exhaust aperture and the input aperture being disposed along generally parallel axes.

39. An apparatus as claimed in claim 23 wherein the vacuum generating means is a Venturi device having an inlet for receiving the compressed gas and an exhaust, the inlet and exhaust being disposed along generally parallel axes.

40. An apparatus as claimed in claim 23 wherein the valve mechanism comprises:

a housing having a generally conical interior chamber and a distribution chamber, the distribution chamber proceeding about less than the full circumference of the conical interior chamber and being in fluid communication with a fluid supply channel, the fluid supply channel being disposed through sidewalls of the housing; and a distribution member connected for synchronous movement with the plurality of picking assemblies along the closed transfer path, the distribution member disposed at least partially in the conical interior chamber of the housing and having a generally conical nose portion conforming to the conical interior chamber, the distributor member and the housing being disposed for relative rotation with one another, the distribution member having a plurality of fluid communication channels formed therein, each of the fluid communication channels having a fluid inlet and a fluid outlet, the fluid inlets of the plurality of fluid communication channels being disposed along the circumference of the conical nose portion at a position coinciding with the distribution chamber, relative rotation of the housing and the distribution member causing selective fluid communication between selected ones of the plurality of fluid communication channels and the distribution chamber.

41. In a packaging machine having a magazine holding carton blanks and a conveyor accepting carton blanks that have been removed from the magazine, an apparatus for transferring the carton blanks from the magazine to the conveyor comprising:

a plurality of picking assemblies that are movable along a closed transfer path, the closed transfer path including a portion between the magazine and conveyor, each of the picking assemblies comprising vacuum generating means for generating a vacuum from a compressed gas, the vacuum generated by the vacuum generating means being operable to allow each of the plurality of picking assemblies to vacuum grip respective carton blanks from the magazine when the picking assembly is supplied with the compressed gas; and valve means for controlling the flow of compressed gas to the plurality of picking assemblies, the valve means controlling the flow of the compressed gas in synchronism with movement of the plurality of picking assemblies so that each of the picking assemblies is cyclically supplied with compressed gas along only the portion of the closed transfer path between the magazine and the conveyor.

42. An apparatus as claimed in claim 41 and further comprising means for erecting the carton blank as it is transported along the portion of the closed transfer path between the magazine and the conveyor.

43. An apparatus as claimed in claim 41 wherein the compressed gas is compressed air.

44. An apparatus as claimed in claim 41 and further comprising a vacuum manifold assembly, the vacuum generating means being disposed in the vacuum manifold assembly.

45. An apparatus as claimed in claim 44 wherein the vacuum manifold assembly comprises:

a. first housing portion including a chamber for holding the vacuum generating means, the first housing portion having an input aperture to facilitate in providing the compressed gas to an input of the vacuum generating means;

a second housing portion including a vacuum manifold chamber in fluid communication with at least one suction cup, the at least one suction cup operable to grip a workpiece upon application of a vacuum to the suction cup; and an intermediate wall disposed between the first and second housing portions, the intermediate wall having an aperture to provide fluid communication between the vacuum manifold chamber and a vacuum output of the vacuum generating means.

46. An apparatus as claimed in claim 45 wherein the first housing portion includes an exhaust aperture substantially co-planar with the input aperture.

47. An apparatus as claimed in claim 45 wherein the first housing portion includes an exhaust aperture, the exhaust aperture and the input aperture being disposed along generally parallel axes.

48. An apparatus as claimed in claim 45 wherein the vacuum generating means is a Venturi device having an inlet for receiving the compressed gas and an exhaust, the inlet and exhaust being disposed along generally parallel axes.

49. An apparatus as claimed in claim 45 wherein the apparatus includes at least three suction cups and wherein the second housing portion includes at least three suction cup apertures that facilitate providing fluid communication between the vacuum manifold chamber, and the at least three suction cups.

50. An apparatus as claimed in claim 49 wherein the vacuum manifold chamber comprises:

a first vacuum subchamber extending between two of the at least three suction cups; and a second vacuum subchamber extending from and transverse to the first vacuum chamber and providing fluid communication between the first vacuum chamber and a third suction cup of the at least three suction cups.

51. An apparatus as claimed in claim 41 wherein the valve means comprises:

a housing having a generally conical interior chamber and a distribution chamber, the distribution chamber proceeding about less than the full circumference of the conical interior chamber and being in fluid communication with a fluid supply channel, the fluid supply channel being disposed through sidewalls of the housing; and a distribution member connected for synchronous movement with the plurality of picking assemblies along the closed transfer path, the distribution member disposed at least partially in the conical interior chamber of the housing and having a generally conical nose portion conforming to the conical interior chamber, the distributor member and the housing being disposed for relative rotation with one another, the distribution member having a plurality of fluid communication channels formed therein, each of the communication channels having a fluid inlet and a fluid outlet, the fluid inlets of the plurality of fluid communication channels being disposed along the circumference of the conical nose portion at a position coinciding with the distribution chamber, relative rotation of the housing and the distribution member causing selective fluid communication between selected ones of the plurality of fluid communication channels and the distribution chamber.

* * * * *